United States Patent [19]

Streit

[11] Patent Number: 4,776,621

[45] Date of Patent: Oct. 11, 1988

[54] DEVICE FOR COLLECTING DOG DROPPINGS

[76] Inventor: Egon Streit, Pitzarweg 20/8156, Otterfing, Fed. Rep. of Germany

[21] Appl. No.: 26,589

[22] Filed: Mar. 17, 1987

[30] Foreign Application Priority Data

Mar. 18, 1986 [DE] Fed. Rep. of Germany ... 8607437[U]

[51] Int. Cl.[4] ..... A01K 29/00; A47L 5/04

[52] U.S. Cl. ..... 294/1.4

[58] Field of Search ..... 294/1.4, 1.3, 1.2, 19.1, 294/55, 50.6, 50.8, 1.1; 15/257.1, 257.3, 257.6, 257.7

[56] References Cited

U.S. PATENT DOCUMENTS 3,901,544 8/1975 Tucciarone ..... 294/1.4
4,056,278 11/1977 Bau et al. ..... 294/1.4
4,119,337 10/1978 Sherhandt ..... 294/1.4
4,478,448 10/1984 Albert ..... 294/1.4

FOREIGN PATENT DOCUMENTS 8517343 5/1985 Fed. Rep. of Germany ..... 294/1.4

*Primary Examiner*—James B. Marbert
*Attorney, Agent, or Firm*—Henry M. Feiereisen

[57] ABSTRACT

A collector for dog droppings includes a stick provided with a support bell at its ground-side end. The stick includes at its lower end an extension which projects through the support bell and is rotatable relative thereto. Connected to the extension is a receiving insert which includes two semicircular plates with one plate movable relative to the other stationary plate so that the insert can be opened and closed for collecting and retaining the waste in the collector and for subsequent disposal thereof.

9 Claims, 2 Drawing Sheets

DEVICE FOR COLLECTING DOG DROPPINGS

BACKGROUND OF THE INVENTION

The present invention relates to a collecting device for dog droppings. Whereas in recent centuries man has succeeded in obtaining satisfactory hygienic conditions for human facilities by the further development of domestic sanitary technology and municipal sewage technology, the situation is still that of the darkest Middle Ages, to use the words of a well-known hygiene expert, when the approach to the problem of dog droppings, in particular in towns, is considered. For as in the past, the usual practice is simply to take the dog for a walk in the street and with the increasing number of dogs, frequently large ones, this leads to a considerable nuisance to the public and even endangers health. Simply prohibiting contamination of parks and pavements is not a solution. The attempt to master the problem with a shovel and paper bag has not resulted in any appreciable success, at least in Germany. Moreover, removing dog droppings with the aid of a small shovel can be very difficult for elderly persons, many of whom are dog owners.

As for any other dog owner, for such persons it would be a great help to have a device at their disposeal which when taking the dog for a walk can be carried along without any difficulty and at the same time permits safe discreet removal of the droppings of the owner's dog in simple manner as well as hygienic final disposal. The problem underlying the invention is to provide such a device.

SUMMARY OF THE INVENTION

This problem is solved by a collecting device for dog droppings as described in the main claim. Advantageous further developments are set forth in the subsidiary claims and for a definition of the terms used and further explanation reference is made to the following description.

The collecting device according to the invention for dog droppings has the form of a walking-stick whose lower end is widened in bell-shaped manner, "bell-shaped" having the broadest sense within the scope of the present invention and covering circular bodies open towards the ground surface of almost any desired shape, for example hemispheres, cylinders, truncated cones or the like. The wall may be closed all round but can also be perforated or basket-like. The peripheral edge of said bell-shaped widening substantially takes up the forces occurring when leaning on a walking-stick and for this reason the bell-shaped widening in the present description is referred to as "support bell". The interior of said support bell is formed towards the bottom by a further part formed by at least two portions and referred to within the scope of the present invention as "receiving insert", the characteristic feature of which is that it is formed from at least two interconnected circular sector-shaped plates pivotal with respect to each other in such a manner that the lower bottom of the support bell is either open in sector-shaped manner, preferably in semicircle form, or by pivoting the one movable plate closed to form a solid circle. Said receiving insert is preferably detachably connected to a rotatable extension of the stick led through the support bell in such a manner that rotation of said extension effects pivoting of the movable sector-shaped plate. In the simplest case the receiving insert is a circular disc made up of the two plate members and having a central plug-type connection piece for the plugging in or on of the extension of the stick. The normal position before use of the collecting means according to the invention is such that the pivotal plate is pivoted behind or in front of the other plate arrested in the support bell so that the bottom face is partially opened. This open face is set down over a heap of droppings, whereafter by turning the extension the pivotal plate is pivoted and moves beneath the droppings, collecting them in the interior of the support bell. In a simplest embodiment the extension is simply the extended end of the stick which is led rotatably through th upper side of the support bell and inserted in slip-free manner into a slightly resilient plug-type connection piece on the rotatable plate. When the support bell, the edge of which can be given any desired shape to improve adhesion to the ground, is pressed against the ground and the walking-stick with the movable plate turned, collection of the droppings is completed. In this position the stick is preferably locked with respect to the support bell by a detent means or the like so that the device can be again used as walking-stick without any risk of the dog excrements dropping out again.

Although the embodiment just described comes under the scope of protection of the present invention as set forth by the claims, the preferred embodiment is however the more complicated one described below with reference to the Figures. However, it is readily within the scope of the technical understanding of an expert or an interested layman to modify the simplest embodiment just described to a greater or lesser extent using elements of the more complicated embodiment described as example.

BRIEF DESCRIPTION OF THE DRAWINGS

Hereinafter the invention will be described with the aid of a preferred embodiment with reference to the Figures, wherein:

FIG. 1 shows the basic elements of the collecting device according to the invention. These are a stick 1, a support bell 2 open on the ground side, an extension 3 which extends the stick 1 and is rotatable together with said stick 1 or independently thereof with respect to the support bell 2 and which is connected to a receiving insert 4 which consists of at least two circular sector-shaped, in this case substantially semicircular, plates 5 and 6 which are pivotal with respect to each other, one of the plates 5 substantially retaining its position with respect to the support bell 2 whilst the plate 6 is pivotal above or below the plate 5. The pivoting of the plate 6 is by rotating the extension 3 which is inserted into or onto a plug-type connecting piece 7. The receiving insert 4 is detachably connected to the extension 3 and is generally a disposable article. For reasons of clarity FIG. 1 shows a state through which the collecting means passes during closing. Usually, before the means is used the sector-shaped plate 6 is behind the plate 5 whilst after use it completely closes the bottom face of the support bell 2 with the dog droppings collected therein.

DESCRIPTION OF PREFERRED EMBODIMENTS

Figure 1:
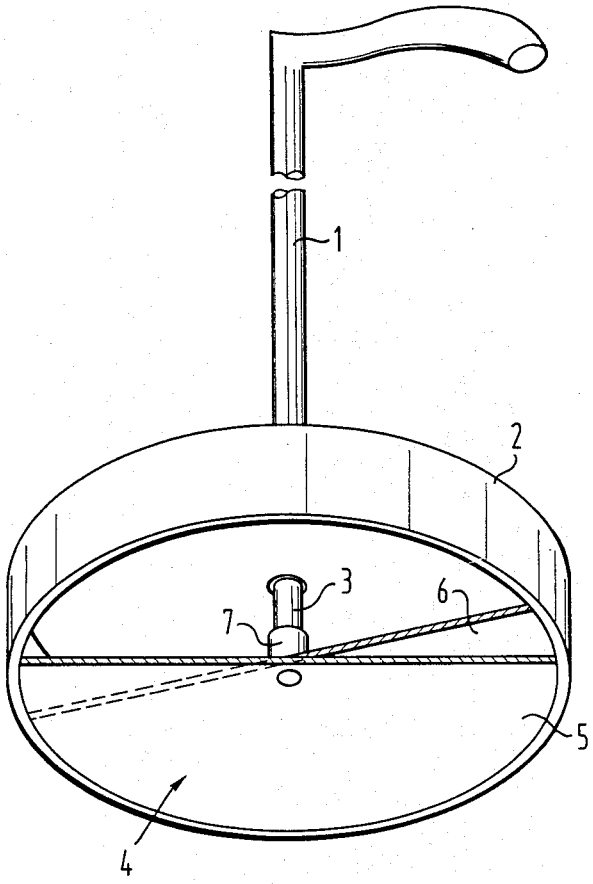
FIG. 1 is a view of a general embodiment of the device according to the invention.

The simplest embodiment shown in FIG. 1 has only an interchangeable bottom plate although the inner walls of the support bell 2 can also be protected by disposable parts possibly to be replaced less often. In FIG. 1 the securing on the extension 3 is by simple insertion into a matching plug-type connecting sleeve 7 on the plate 6 which is rotatably connected with an eye or the like to the plate 5.

Figure 4:
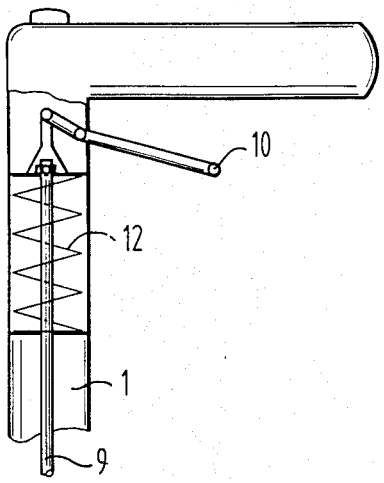
FIG. 4 shows the grip portion of a device according to the invention which matches the support bell according to the partial view of FIG. 2.
Figure 2:
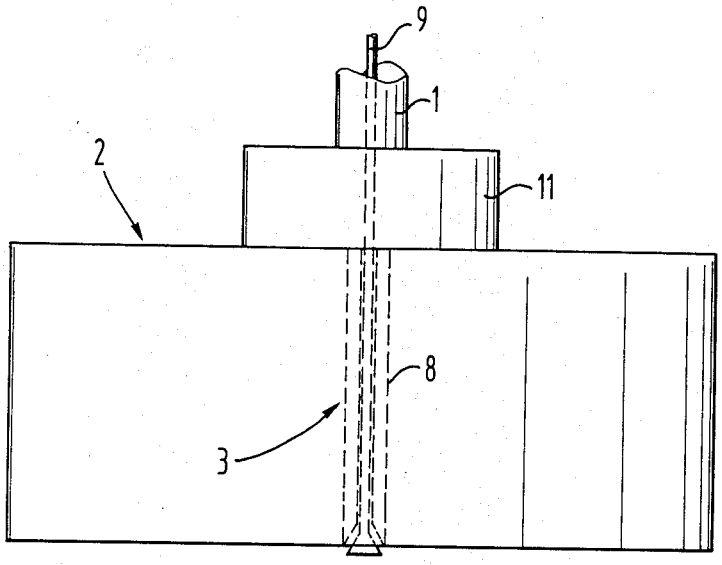
FIG. 2 is a partial view of the means according to the invention in a preferred embodiment with the securing elements for the receiving member, which is not inserted.
Figure 3:
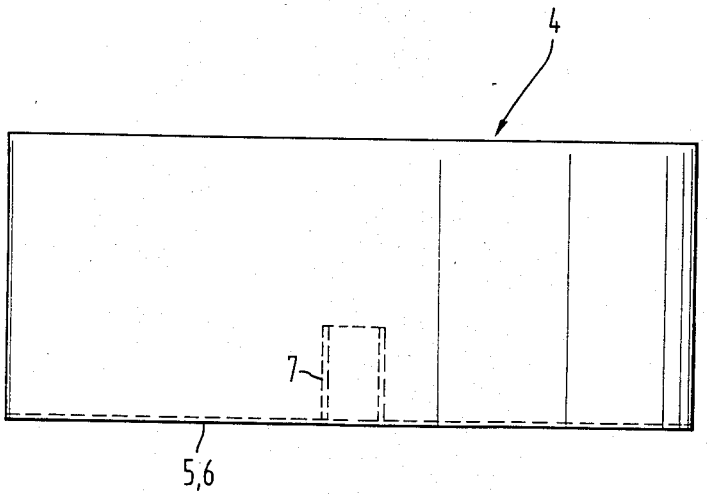
FIG. 3 shows a box-shaped receiving member fitting the device shown in FIG. 2.

Although this embodiment is of greater simplicity it has a number of disadvantages which are obviated in the embodiment shown in FIGS. 2 to 4.

FIG. 2 shows a support bell 2 in which the stick 1 is made tubular and terminates on the upper side of the housing 11 for an electric motor. The shaft of the electric motor forms in this case part of the extension 3. The shaft 8 is tubular and slit once or more in the longitudinal direction. Extending through its axis into the hollow tubular stick 1 is a core rod 9 which is movable in the axial direction and which comprises at its end a thickening or projecting which interact with corresponding associated faces of the tubular shaft 8 in such a manner that the portions lying between the slits are expanded when the core rod 9 is moved in the axial direction towards one side. The thickening or the projections can have any desired known forms. Thus, the thickening may be a sphere, a ball or a similar conical body which cooperates with correspondingly inclined or curved faces of the tubular shaft 8 and thus expands said tubular shaft 8. Instead of one projection however projections or similar wedges can be provided extending in correspondingly formed slits in the tubular shaft 8. By pulling the core rod 9 against the engagement faces of the tubular shaft 8 the latter is expanded.

In the device according to the invention the core rod 9 is usually biased in the sense of expansion of the tubular shaft 8, for example with the aid of a mechanism as shown in FIG. 4 and located in the grip portion of the stick 1. In this mechanism a pressure spring 12 pushes the core rod 9 upwardly. By actuating a lever 10 the core rod 9 is moved downwardly, overcoming the spring force, and this leads to the resilient tubular shaft 8 no longer being expanded and its diameter being reduced. Since, as explained below, on actuation of the means the electric motor rotates the tubular shaft 8 through about half a revolution, either the thickening on the core rod 9 must also be rotatable or the entire core rod 9 must be rotatable or twistable in the region indicated. If the core rod 9 is made of a resilient twistable plastic material having adequate tensile strength it is not necessary to provide any bearings for a rotation of the core rod 9.

The device according to the invention is made ready for use in that the tubular shaft 8 shown in FIG. 2 is relieved by downward movement of the core rod 9 and is introduced into a usually sleeve-shaped plug-type connection piece 7 of an interchangeable receiving insert 4. The core rod 9 is then moved upwardly, usually with relieving of the pressure spring at its other end, and expands the tubular shaft 8 so that a reliable slipproof connection is established between the tubular shaft 8, forming in the present case the outer periphery of the extension 3, and the plug-type connecting piece 7. On insertion the plates 5 and 6 are usually disposed one behind the other so that part of the bottom face, usually half thereof, is open.

The receiving member may be a simple circular disc which is made up of the two plates 5 and 6 and held in the lower edge region of the support bell 2 by corresponding annular extensions or it may have a drawn-up cylindrical edge which covers the peripheral walls of the support bell 2; alternatively, it may be almost completely closed and have a passage for pushing through the extension 3 only opposite the plug-type connecting piece 7.

The form which the receiving member 4 is given will depend on considerations regarding price, space requirement and hygiene.

In use the device described in FIGS. 2 to 4 is placed with its bottom face half open over a heap of droppings, the electric motor is then actuated, preferably with the aid of a switch disposed on the grip portion, and the electric motor turns the movable sector-shaped (approximately semi-circular) plate 5 through about 180°. The plate 5 moves in the manner of a scoop beneath the droppings and collects them in the interior of the support bell 2. The droppings can then remain for the remainder of the walk in the support bell and at a suitable point placed in refuse together with the receiving insert 4, this being done by simply pulling the lever 10 shown in FIG. 4 to compress the pressure spring, the receiving member then dropping out of the support bell. When the receiving member 4 is closed all round it can be disposed of in very hygienic manner.

Since the receiving member 4 is a disposable article and should preferably not lead to any problems in refuse, it is preferably made of a paper of adequate strength, the moving plate 5 however preferably being made of a cardboard of adequate strength. The actual device may be made of any materials and material combinations, that is metal, wood and plastic, plastic materials possibly being preferably for costs reasons.

The electric motor provided in the preferred embodiment is battery driven, arrangement of the battery in the stick, the grip portion of the stick or the support bell not presenting any problems. Instead of an electric motor in a modification of the embodiment illustrated a spring motor (clockwork) can be used which can be wound up for example by depressing a rod projecting at the bottom out of the support bell and arrested in the wound-up position, being releasable via an actuating means in the grip portion. Such a modified embodiment is also within the scope of the present invention.

As already described, the receiving insert 4 retains with its one plate 5 a substantially fixed position with respect to the support bell 2. This is necessary to guarantee a closing of the bottom face during pivoting of the pivotal plate 6. The required locking of the plate 6 of the receiving insert 4 can simply be provided in various manner. For example, the support bell 2 may be provided with a projection which engages in a recess of the receiving insert 4 to prevent a rotation of the latter and may be located in the area of the lower circumferencial edge, the side wall or also on the cover plate of the support bell 2.

As has also been mentioned, the support bell 2 may be perforated or of basket shape. Such a design allows an optical control during opening of the receiving insert 4. For this purpose, markings may additionally be provided at suitable locations. Alternatingly, a support bell made of transparent material may be used. Since the receiving insert is locked with respect to the support bell and thus is always arranged therein in the same manner, it is also possible to provide markings on the walking-stick for indicating the rotation of the extension 3 and thus the open or closed position of the receiving insert.

While the invention has been illustrated and described as embodied in Collecting Means for Dog Droppings, it is not intended to be limited to the details shown since various modifications and structural changes may be made without departing in any way from the spirit of my present invention.

What is claimed as new and desired to be protected by Letters Patent is set forth in the appended claims:

1. A device for collecting dog droppings, comprising:

an elongated hollow stick having a lower end;

a support member open toward the ground and connected at said lower end of said stick;

a replaceable receiving insert connectable to said support member and having at least two plates for opening and closing said support member;

fastening means for connecting said plates to each other in a manner to allow relative movement between said plates; and an electromotor including a shaft traversing said support member and detachably fixed to said receiving insert, said electromotor being interposed between said stick and said support member and acting upon said receiving insert for moving one of said plates relative to the other one of said plates thereby selectively opening and closing said support member toward the ground, with one of said plates being stationary when activating the device.

2. A device as defined in claim 1 wherein said fastening means includes a central sleeve connected to one of said plates of said receiving insert, said shaft of said electromotor being detachably fixed in said central sleeve.

3. A device as defined in claim 2, and further comprising clamping means for detachably fixing said shaft in said sleeve, said clamping means including a rod movable in longitudinal direction thereof and extending through said shaft and said stick, said rod having one enlarged end for widening said shaft when being inserted in said sleeve to provide a frictional engagement therebetween.

4. A device as defined in claim 3 wherein said shaft is slotted in direction of its elongation to allow the widening thereof by said enlarged end of said rod.

5. A device as defined in claim 3 wherein said clamping means further includes a spring urging said rod with its enlarged end into said shaft for widening the latter, and a lever connected to said rod such that upon actuation of said lever said rod is shifted against the pressure exerted by said spring to allow disengagement of said enlarged end from said shaft.

6. A device as defined in claim 3 wherein said shaft is made of resilient twistable plastic material.

7. A device as defined in claim 2 wherein said plates are of circular sector shape complementing each other to a full circle.

8. A device as defined in claim 1 wherein said receiving insert is made of paper, plastic, cardboard, or any combination thereof.

9. A device as defined in claim 1 wherein said support member is a support bell of inverted U-shape.

* * * * *